US005592201A

United States Patent [19]

Lim

[11] Patent Number: 5,592,201

[45] Date of Patent: Jan. 7, 1997

[54] MANUAL PRIMING PUMP FOR INKJET PRINTING MECHANISMS

[75] Inventor: Swee K. Lim, Singapore, Singapore

[73] Assignee: Hewlett-Packard Company, Palo Alto, Calif.

[21] Appl. No.: 235,066

[22] Filed: Apr. 28, 1994

[51] Int. Cl.[6] ..... B41J 2/165

[52] U.S. Cl. ..... 347/30; 347/92

[58] Field of Search ..... 347/30, 32, 92, 347/93; 417/307

[56] References Cited

U.S. PATENT DOCUMENTS

| | | | |
|---|---|---|---|
| 3,597,119 | 8/1971 | Gratzmuller | 417/360 |
| 3,929,071 | 12/1975 | Cialone et al. | 101/335 |
| 4,012,174 | 3/1977 | Seibel et al. | 417/307 |
| 4,170,016 | 10/1979 | Geil | 347/30 |
| 4,273,158 | 6/1981 | Chun | 138/30 |
| 4,305,701 | 12/1981 | Geil | 417/307 |
| 4,394,669 | 7/1983 | Ozawa et al. | 347/86 |
| 4,567,494 | 1/1986 | Taylor | 347/30 |
| 4,586,058 | 4/1986 | Yamaxaki et al. | 347/92 |
| 4,853,717 | 8/1989 | Harmon et al. | 347/29 |
| 4,907,018 | 3/1990 | Pinkerpell et al. | 347/87 X |
| 4,929,963 | 5/1990 | Balazar | 347/89 |
| 4,998,115 | 3/1991 | Nevarez et al. | 347/35 |
| 5,141,411 | 8/1992 | Klaeger | 417/445 |
| 5,420,619 | 5/1995 | Glasset et al. | 347/30 |

FOREIGN PATENT DOCUMENTS

| | | |
|---|---|---|
| 0569155 | 4/1993 | European Pat. Off. . |
| 2115305 | 1/1983 | United Kingdom . |

OTHER PUBLICATIONS

Research Disclosure, Sep. 1990, 31760–31762, pp. 748–749.

*Primary Examiner*—John E. Barlow, Jr.
*Attorney, Agent, or Firm*—Flory L. Martin

[57] ABSTRACT

A manually actuated, spring biased, unidirectional piston pump assembly is provided for purging ink from the lines and/or nozzles of an inkjet printing mechanism. The pump's piston plunger may be stroked several times by an operator's finger to generate a pressure profile that effectively primes an ink cartridge after periods of primer inactivity. A series of baffles, comprising fingers located in an entrapment chamber of the pump, separates the ink from air being purged from the lines. The collected ink droplets fall onto an absorbent diaper material, which captures the purged ink. The pump may also be constructed as a stand-alone priming apparatus for priming a pen cartridge before installation in an inkjet printing mechanism. Preferably the pump components are constructed for snap interfits which facilitate ease of assembly and decrease costs associated with manufacturing. When the pump components are molded from plastics, the overall pump is lighter in weight and well suited for either desktop or portable inkjet printing mechanisms. A method is also provided of priming an inkjet cartridge pen used in an inkjet printing mechanism.

19 Claims, 8 Drawing Sheets

MANUAL PRIMING PUMP FOR INKJET PRINTING MECHANISMS

FIELD OF THE INVENTION

The present invention relates generally to priming devices for an inkjet printing mechanism, and more particularly to a manual axial piston pump apparatus for use as a primary, auxiliary or backup ink priming system.

BACKGROUND OF THE INVENTION

Inkjet printing mechanisms use pens which shoot drops of ink onto a page or sheet of a print medium. Each pen has a printhead formed with very small nozzles through which the ink drops are fired. To print an image, the printhead moves back and forth across the page shooting ink drops as it moves. Inkjet printing mechanisms may be included in a variety of different devices, such as inkjet printers, plotters, scanners, facsimile machines, or other devices, all of which are referred to collectively herein as "inkjet printers." The print medium is typically a sheet material, such as paper, mylar, foils, transparencies, card stock, etc., but for convenience the term "paper" is used herein for purposes of illustration.

Inkjet printers typically require the pen cartridges or ink lines to be primed, such as after periods of inactivity, or upon replacement of the ink supply. The act of priming forces ink from the supply reservoir through the nozzles to ready the printer for printing. While some printing systems use complicated electrically operated pumping mechanisms, such as peristaltic pumps, these pumping systems typically increase the power consumption of the inkjet printer. Moreover, these automatic systems are often costly, complicated, and occasionally subject to failure, if not in the mechanical pump portion, then in the control functions. The automatic pump and motor systems also increase the weight of the overall printing unit.

Thus, there is a need for a simple and efficient priming system, which is lightweight, easy to assemble, and which may be used without increasing the power drain on the printer. Such a priming apparatus would be particularly useful for a printer which has only occasional use, such as a printer for the home environment, or for a backup or portable unit.

SUMMARY OF THE INVENTION

According to one aspect of the invention, a priming pump apparatus for use in an inkjet printing mechanism having an inkjet printhead is provided. The apparatus has a body defining a main chamber having inlet and outlet ports. The body is mountable to a surface for defining an ink entrapment chamber between the body and said surface when mounted thereto. The apparatus also has an activation device operable to draw a vacuum on the printhead when the priming apparatus is placed in fluid communication therewith to purge a mixture of ink and gaseous compounds accumulated in the printhead. An intermediate valve selectively places the entrapment chamber in fluid communication with the main chamber. The body defines the entrapment chamber in a configuration to receive the accumulated mixture upon operation of the activation device. The body also defines a series of baffles in the entrapment chamber, with the baffles configured to allow the gaseous compounds to vent to atmosphere through the main chamber outlet port and to extract ink from the purged mixture. Such a priming apparatus may also be supplied as a stand-alone unit for use in priming cartridges removed from an associated printing mechanism.

According to another aspect of the present invention, an ink jet printing mechanism is provided as including a chassis and a print medium handling system for supplying a print medium to a printing zone. The mechanism includes a printhead carriage system which propels an inkjet pen, comprising an ink reservoir and a printhead, across the printing zone to selectively deposit ink on the print medium. The mechanism further includes a priming pump supported by the chassis to be selectively placed in fluid communication with the printhead. The pump includes an activation device operable to draw a vacuum on the printhead when placed in fluid communication therewith to purge a mixture of ink and gaseous compounds accumulated in the printhead. The pump has an outlet port which vents the gaseous compounds to atmosphere, and an ink entrapment chamber with a baffled interior that extracts ink from the purged mixture.

According to another aspect of the present invention, a method of priming an inkjet cartridge pen used in an inkjet printing mechanism is provided which includes the step of removing the inkjet cartridge from the inkjet printing mechanism. In a providing step, a priming pump as described above may be included. The priming pump includes a pen support for supporting the pen. In a placing step, the pen is placed in the pen support of the priming pump. In a stroking step, the activation device is stroked to purge gases from the pen and to separate any ink therefrom.

One goal of the present invention is to provide a lightweight simple and efficient priming unit for use in inkjet printing mechanisms.

A further goal of the present invention is to provide a priming unit assembly for priming inkjet cartridges which have been removed from an ink jet printing mechanism, or not yet attached thereto.

Another object of the present invention is to provide an inkjet priming system which is easy to assemble, and relatively low in cost to manufacture, thereby providing a more economical inkjet printing mechanism.

DETAILED DESCRIPTION OF THE PREFERRED EMBODIMENTS

Figure 1:
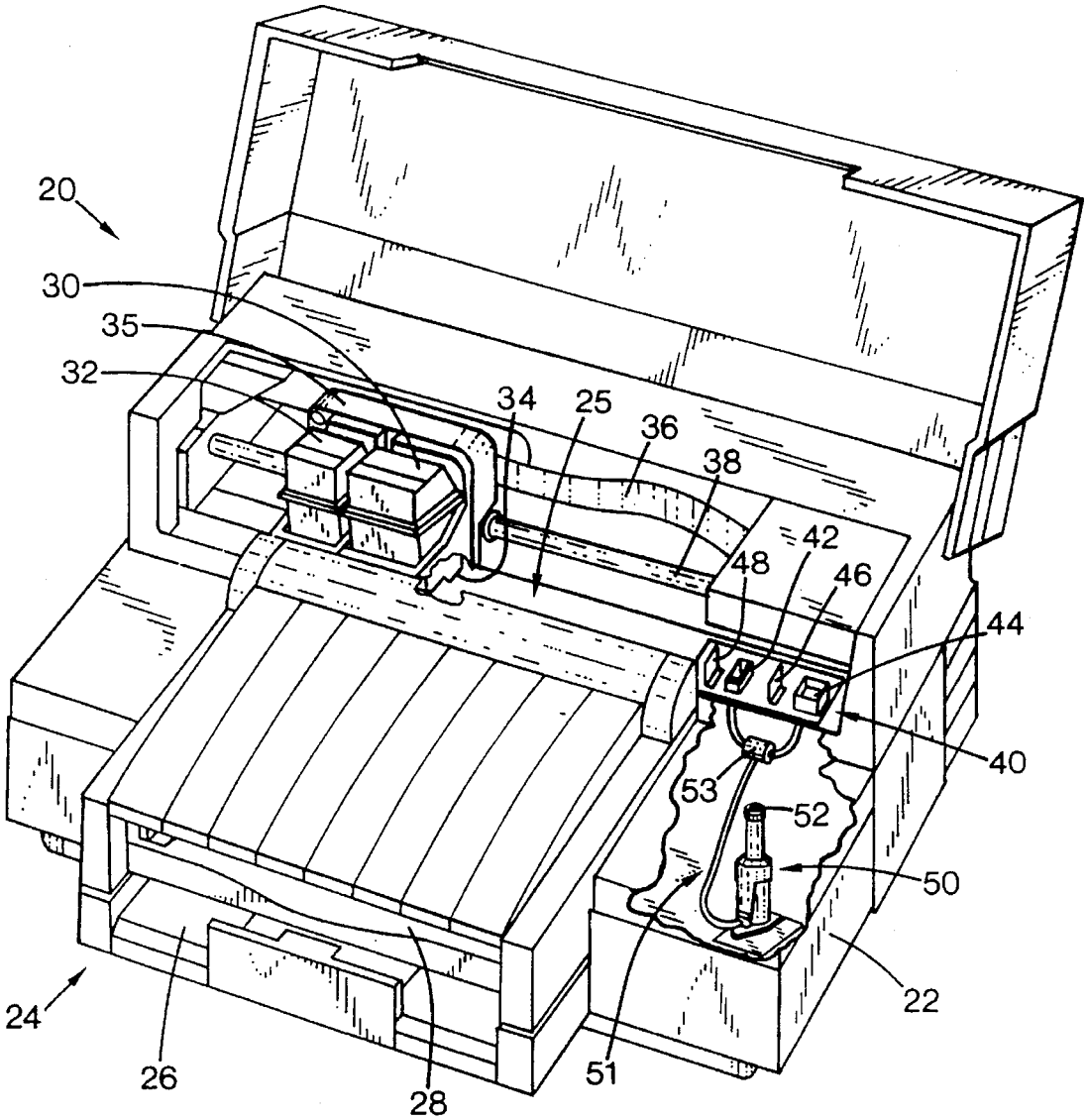
FIG. 1 is a fragmented perspective view of one form of an inkjet printing mechanism showing one form of a manual priming pump of the present invention.
Figure 2:
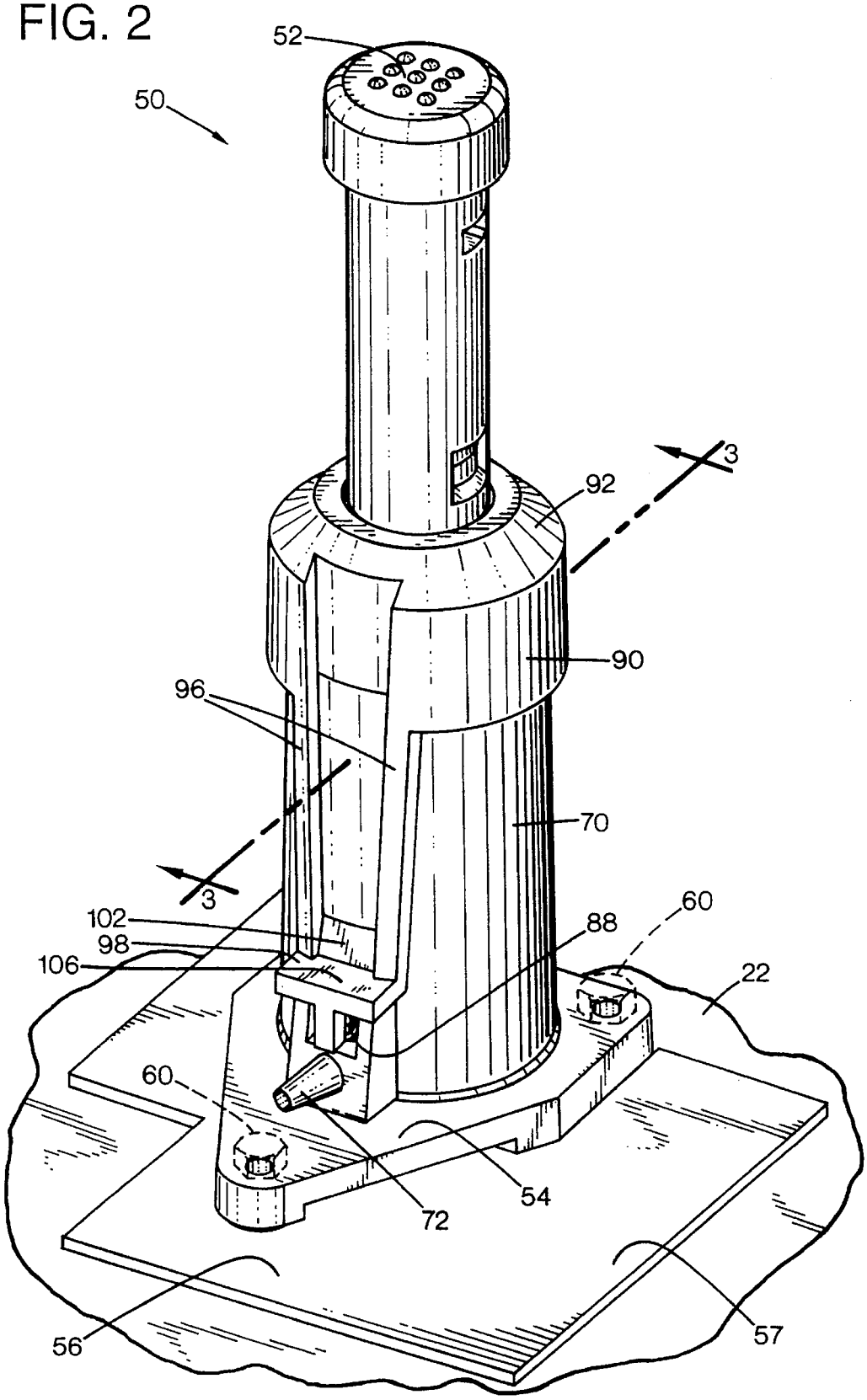
FIG. 2 is an enlarged perspective view of the priming pump of FIG. 1.

FIG. 1 illustrates an embodiment of an inkjet printing mechanism, here shown as an inkjet printer 20, constructed in accordance with the present invention, which may be used in desktop publishing, in printing business reports, correspondence, and the like, in either an industrial, office or home environment. Other inkjet printing mechanisms may embody the present invention, such as plotters, portable printing units, and facsimile machines, to name a few, but for convenience the concepts of the present invention are illustrated in the environment of an inkjet printer 20.

While it is apparent that the printer components may vary from model to model, the typical inkjet printer 20 includes a chassis 22 and a print medium handling system 24 for supplying a print medium to the printer 20. The print medium may be any type of suitable sheet material, such as sheets of paper, card-stock, foils, mylar, transparencies, and the like, but for convenience, the illustrated embodiment is described using paper as the print medium. The print medium handling system 24 includes a drive motor and a series of rollers (not shown) for delivering the sheets into a print zone 25 from a feed tray 26, and then into an output tray 28. In the print zone 25, the ink droplets are shot from an inkjet cartridge or pen, such as a color ink cartridge 30 and/or a black ink cartridge 32. The illustrated color cartridge 30 is a tri-color pen, although in some embodiments (not shown), a group of discrete monochrome pens may be used, or a single monochrome black pen 32 may be used.

The illustrated cartridges 30, 32 each include reservoirs for storing a supply of ink therein, although other ink supply storage arrangements, such as those having reservoirs mounted along the housing (not shown) may also be used. The cartridges 30, 32 each have a printhead, such as printhead 34 on the color cartridge 30. Each printhead 34, 36 has bottom surface comprising an orifice plate (not shown) with a plurality of nozzles formed therethrough in a manner well known to those skilled in the art. In the illustrated embodiment, the cartridges 30, 32 have thermal inkjet printheads, although other types may be used, such as piezoelectric printheads. A thermal printhead typically includes a plurality of resistors (not shown) which are associated with the nozzles. Upon energizing a selected resistor, a bubble of ink is formed and then ejected from the nozzle into the print zone 25 and onto a sheet of paper under the nozzle.

The pens 30, 32 are transported by a carriage 35 which may be driven along a guide rod 36 by a conventional drive belt/pulley and motor arrangement (not shown). The pens 30, 32 selectively deposit one or more ink droplets on a sheet of paper in accordance with instructions received via a conductor strip 38 from a printer controller, such as a microprocessor (not shown), located within chassis 22. The controller generally receives instructions from a computer (not shown), such as a personal computer. The printhead carriage 35, as well as the carriage motor (not shown) and paper handling system drive motor (not shown) each operate in response to the printer controller, which operates manner well known to those skilled in the art. A monitor (not shown) coupled to the computer may be used to display visual information to an operator, such as the printer status or a particular program being run on the computer. Personal computers, their input devices, such as a keyboard and/or a mouse device (not shown), and monitors are all well known to those skilled in the art.

The printer 20 may include a conventional service station assembly 40 having a platform upon which may be mounted conventional inkjet pen caps, such as a black ink cap 42 and a color cap 44. The platform may also support conventional color and black ink wipers 46, 48 for wiping the printheads of the respective color and black cartridges 30, 32, such as the color printhead 34. The pen caps 42, 44 may also be used to facilitate a priming function for priming the pens 30, 32, as described further below.

FIG. 1 illustrates an embodiment of a manual priming pump apparatus 50 constructed in accordance with the present invention installed in the primer 20. A priming conduit assembly 51, for instance comprising one or more lengths of a resilient tubing, fluidically couples the pump 50 with each of the pen caps 42, 44. The pump includes an actuating plunger 52, which extends through a portion of the chassis 22 where it can be accessed for manual operation. It is apparent that two priming pumps may be used, one for each pen 30, 32, although the illustrated embodiment has only a single pump 50, which may be selectively coupled to either cap 42 or 44 by actuation of a conventional valve, such as a shuttle or spool-type valve 53.

Referring now to FIGS. 2–5, the various components of the illustrated embodiment of pump 50 are shown in greater detail. The pump 50 has a base 54 sitting upon an elastomer gasket 55, which in turn rests upon a sheet of an ink absorbent material, also known as an ink diaper 56. The diaper 56 may be any suitable form of felt, textile, pressboard or any liquid absorbing material. The gasket 55 may be any type of elastomer suitable for creating a liquid impervious seal around the base portion 54. The gasket 55 has an aperture 58 therethrough, which allows ink drawn by the pump 50 during the priming process (described further below) to flow from the pump onto the diaper 56. Through capillary action, ink deposited near a central region of the diaper 56 then flows to the outer regions 57. The periphery of diaper 56 may be cut in various geometric forms to conform to the structure of the particular printer chassis 22.

A series of bolts 60 or other fasteners may be used to secure the pump base 54 to the printer chassis 22, by extending through holes 62 in the base, as well as through holes 64 and a notched portion 66 in the diaper 56. The gasket 55 may also be formed to define notches 68 for being positioned adjacent to two of the bolts 60, which assists in the ease of assembling pump 50 into the printer 20.

The illustrated pump 50 has a body 70 which is preferably molded as a single piece integral with the base portion 54. The body 70 includes an ink inlet nozzle 72, preferably having a tapered exterior sized to be received within and resiliently retained by a portion of the ink tubing assembly 51. The nozzle 72 defines an ink inlet passageway 74, which leads to a baffled ink entrapment chamber 75 defined by body 70. The pump 50 has a series of baffling members, here illustrated as a plurality of plastic fingers 76 extending downwardly from a ceiling portion 78 of chamber 75. The baffle fingers 76 are arranged in a maze-work which disrupts the air flow, impedes the flow of ink through the entrapment chamber 75, and separates the ink from any air or other gases being purged from the printheads of pens 30 and 32. The entrapped ink collects along the fingers 76, and preferably forms droplets 79 which roll downwardly under the force of gravity along the fingers 76. Eventually the droplets 79 fall onto the central region of diaper 56, where they are absorbed.

To provide a suction force which draws the purged ink and air from the printheads of pens 30, 32, the pump body 70 defines an intermediate passageway 80 that joins the entrapment chamber 75 with a main pump chamber 82, also defined by body 70. The passageway 80 is configured to serve as a valve seat 83 for a valve, here, a ball valve 84. The illustrated pump body 70 has two cavities 85 and 85' formed therein which are extraneous to the priming function of pump 50. The cavities 85 and 85' merely serve to reduce the wall thickness of the body 70, which enhances ease of manufacture and the molding characteristics of the body, in a manner well known to those skilled in the art. The body 70 also defines an outlet passageway 86 extending from the main chamber 82 to the exterior of body 70. The passageway 86 is configured to form a valve seat 87 for an outlet valve, such as a ball valve 88. The ball valves 84 and 88 may be constructed of any suitable material, although plastic is preferred to so as to have a shorter time span for each valve 84, 88 to be closed, as well as to enhance the overall lightweight nature of pump 50.

The pump 50 has a cover member 90 with a head portion 92 and two leg members 94, 96 extending downwardly from the head 92. The leg 96 terminates in a foot portion 98, which extends over a portion of the outlet passageway 86 to secure the ball valve 88 to the pump assembly 50 when the outlet passageway 86 is open (see FIG. 6). The cover 90 is secured to the body 70 by two hook members 100 and 102 which extend outwardly from body 70 to engage land portions 104 and 106 of the cover legs 94 and 96, respectively. Thus, the cover 90 may be advantageously snap-fit over the body 70, further enhancing the ease of assembling pump 50.

Besides sealing the pump main chamber 82 with the ball valves 84 and 88, a cup-shaped elastomer washer 110 is also used. The washer 110 includes a recessed bowl portion 112, which is surrounded by an annular land portion 114. An annular sealing ring 116 extends outwardly from the land portion 114, and is preferably recessed slightly below the upper surface of land 114. The sealing ring 116 has an outer diameter $D_1$ which is slightly larger than an inner diameter $D_2$ of the main pump chamber 82 (see FIG. 4). The larger diameter $D_1$ of the sealing ring 116 provides an interference fit with the body 70 to seal the upper portion of the main chamber 82. Additionally, the sealing ring 116 provides added friction to control the pump's piston action when drawing purged ink and air through pump 50 during priming, as described further below.

The pump 50 also has a piston 120, which may be a hollow, generally cylindrical member. The piston 120 includes a tapered ram portion 122 which is sized to be received within bowl 112 of washer 110. Above the ram 122, the piston 120 has a shoulder portion 124 which sits upon the land 114 of washer 110. Opposite the ram end 122, the piston has a cap-receiving end 125 which has two opposing notches therethrough, one of which is shown as notch 126, for receiving hook members 128 of plunger 52.

Figure 5:
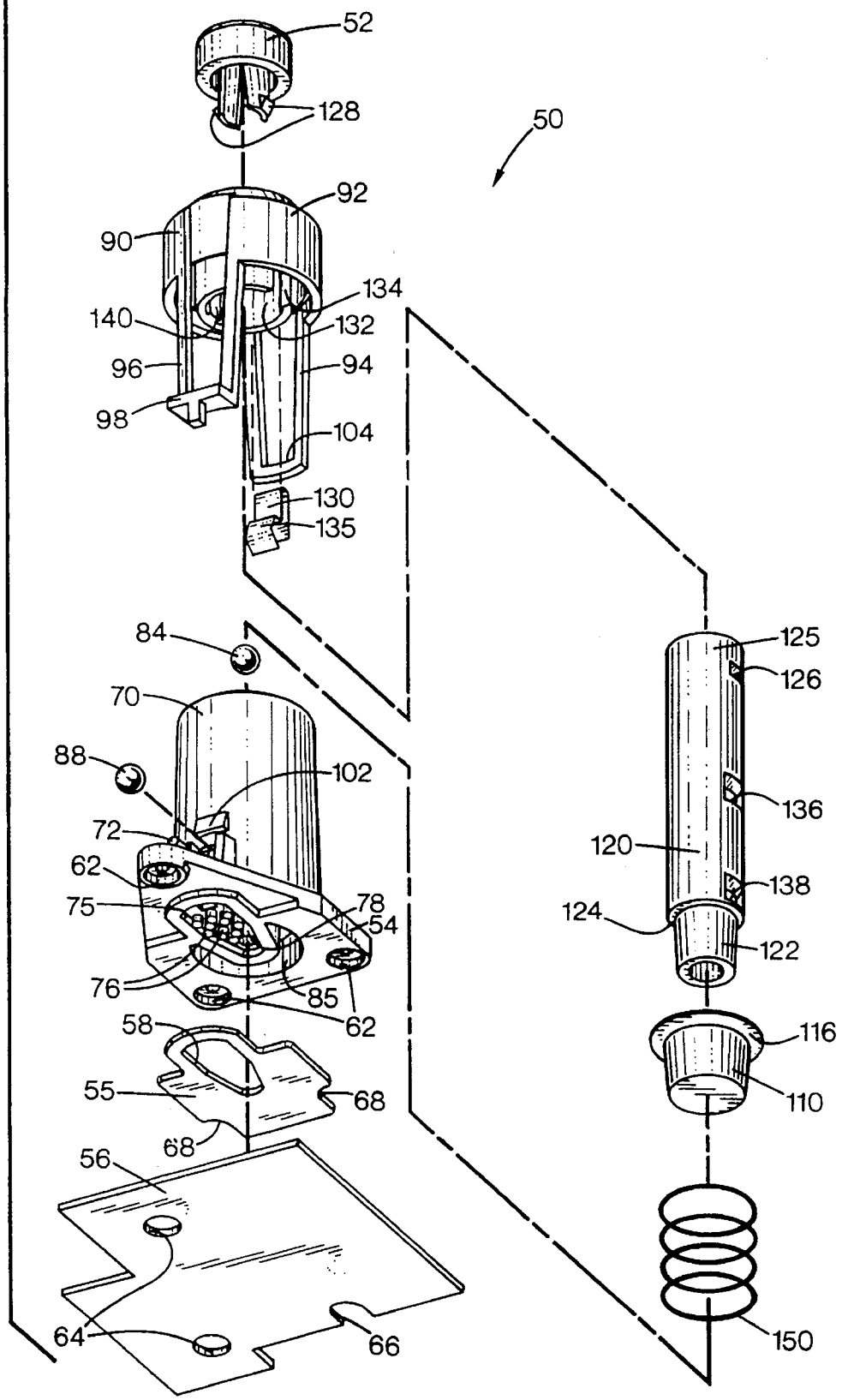

A leaf spring member 130 is used to retain the piston 120 within the pump cover 90. As best shown in FIG. 5, the cover 90 has a sleeve member 132 which is internal to, and extends downwardly from the cover head 92. The sleeve 132 defines an upwardly extending slot 134 sized to receive the retaining spring 130. The spring 130 has a retaining protrusion 135 which is received within recesses 136 and 138 of piston 120 to retain the piston within the pump body 70.

To assure that the recesses 136, 138 are engaged by the spring protrusion 135, rotation of the piston 120 within cover 90 is prevented by engagement of a rail member 140 with a groove 142. In the illustrated embodiment, rail 140 is formed along the inner periphery of the cover sleeve 132. The mating groove 142 (see FIG. 4) is defined by a channel extending along at least a portion of the length of piston 120, substantially parallel to an axis 144 of the piston.

Figure 3:
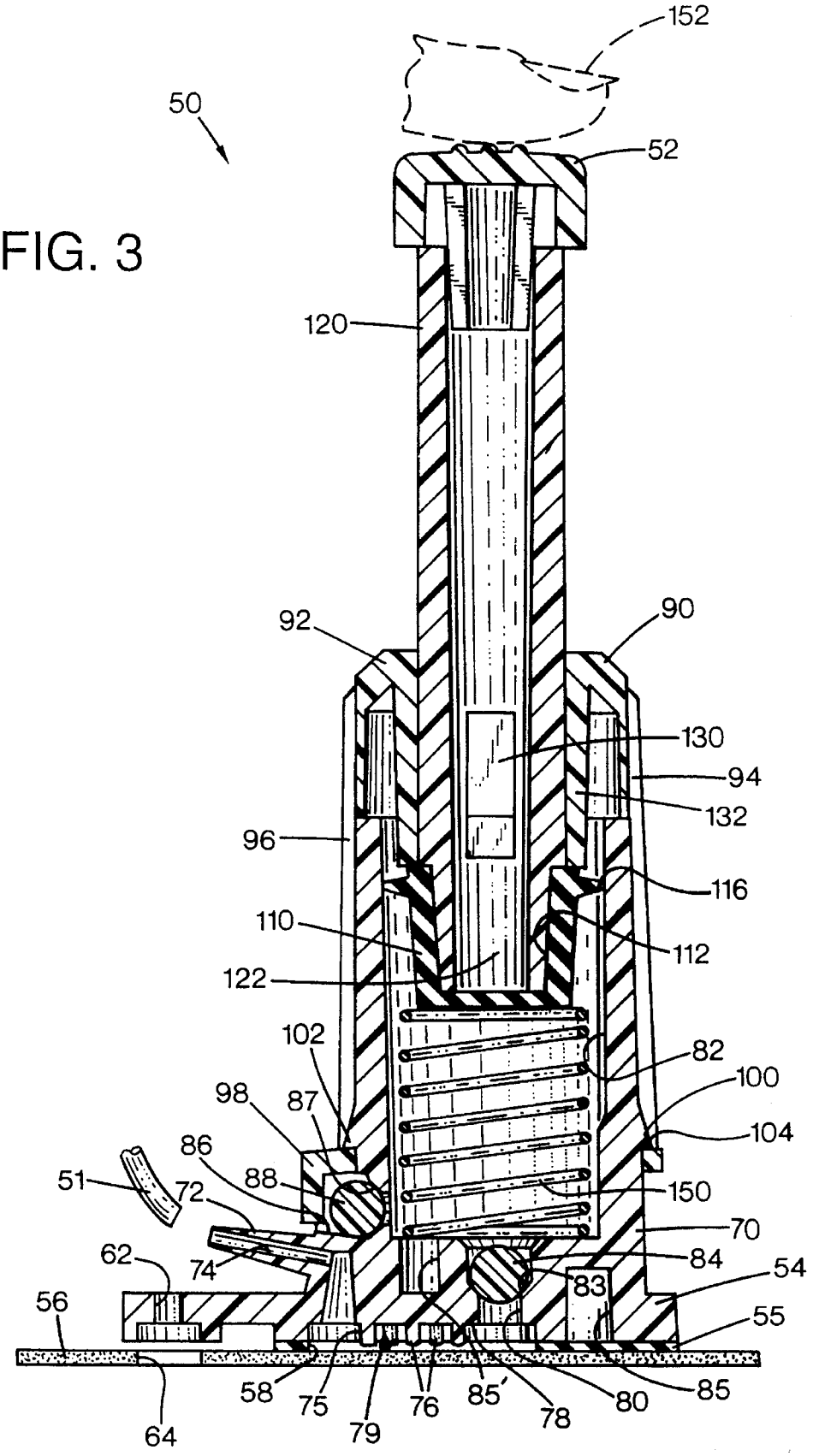
FIG. 3 is an elevational cross sectional view taken along lines 3—3 of FIG. 2.
Figure 4:
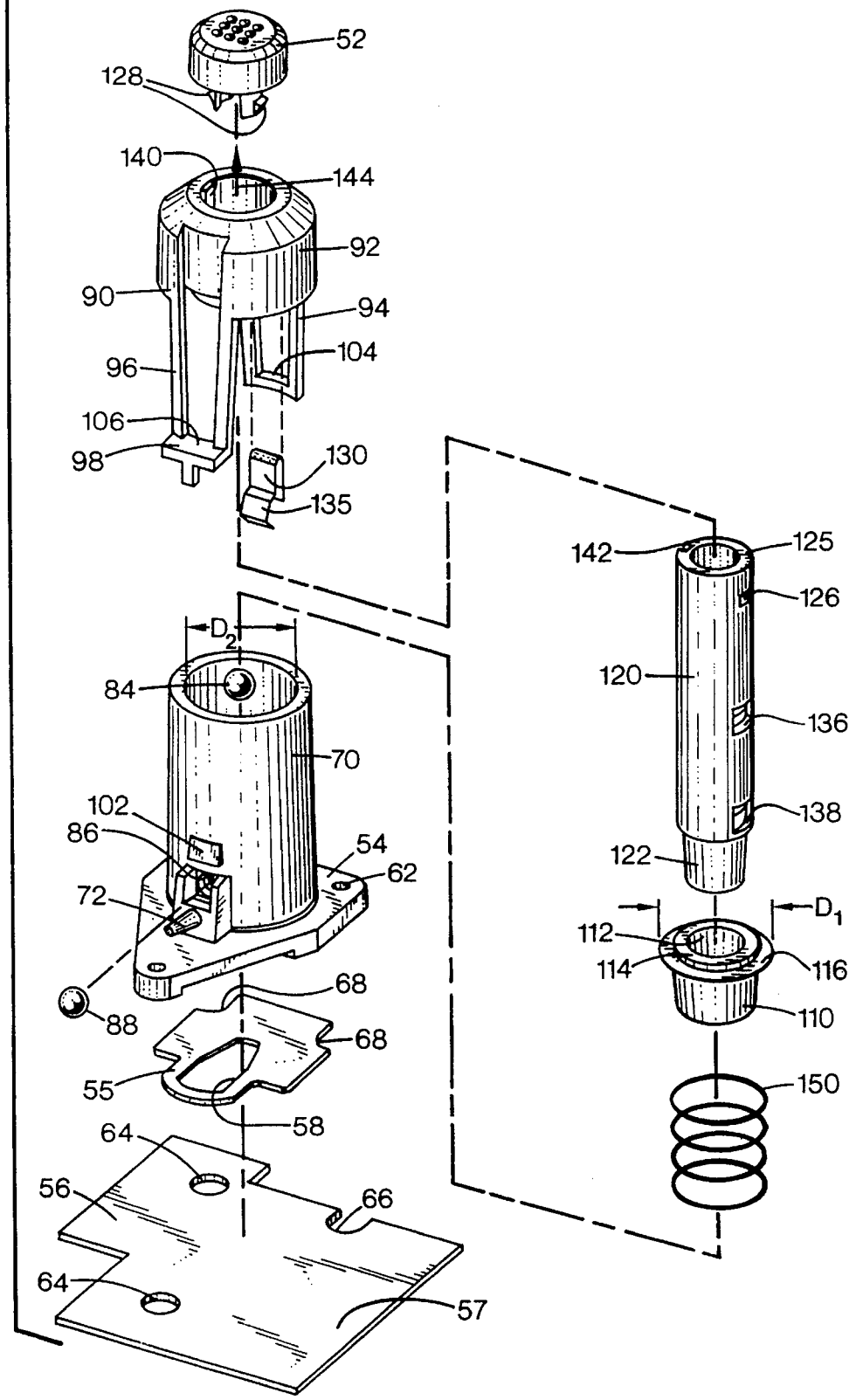
FIGS. 4 and 5 are exploded perspective views of the pump of FIG. 2 viewed from opposite ends of the pump.

To bias the piston 120 in an upward or relaxed condition, as shown in FIG. 3, the pump 50 includes a compression coil spring 150. A lower end of the spring 150 rests on the lower surface of the main chamber 82, and retains the ball valve 84 within the intermediate chamber 80 when valve 84 is open (see FIG. 7). An upper end of spring 150 rests on the lower surface of the washer cup portion 112, opposite the piston ram 122. While the terms "upper" and "lower" are used herein to describe the various components of pump 50 with respect to the orientation of the drawings, it is apparent that the pump 50 may be operated in other orientations, provided that the entrapped ink droplets travel from the baffling fingers 76 to the diaper 56. This can easily be accomplished under the force of gravity if the pump is operated at an acute angle from vertical. For example, the illustrated pump 20 is believed to have been tested with good results achieved when the pump axis 144 (FIG. 4) is located up to about thirty degrees variation from vertical.

Figure 6:
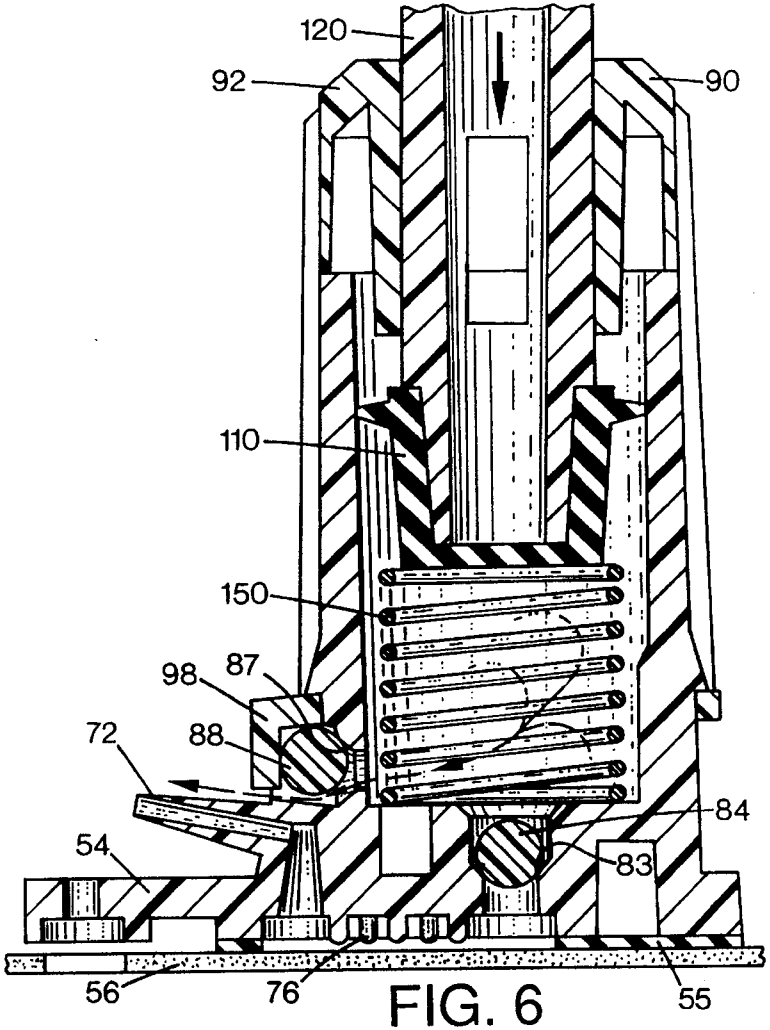

In operation, the pump 50 is used to draw ink, air and any other gases through the nozzles and the conduit assembly 51 to prime the ink cartridges 30 and 32. Referring also to FIG. 6, from the relaxed condition shown in FIG. 3, the piston 120 may be manually depressed by an operator's finger 152 pushing downwardly on the plunger 52, so the piston 120 compresses spring 150. During this compression stroke, the outlet ball valve 88 opens and air is expelled from the main pump chamber 82, while the inlet ball valve 84 seals the main chamber by remaining closed against valve seat 83. At the end of the compression stroke, the operator's finger 152 may be removed from plunger 52 to begin an extraction or suction stroke of the priming process using pump 50.

Figure 7:
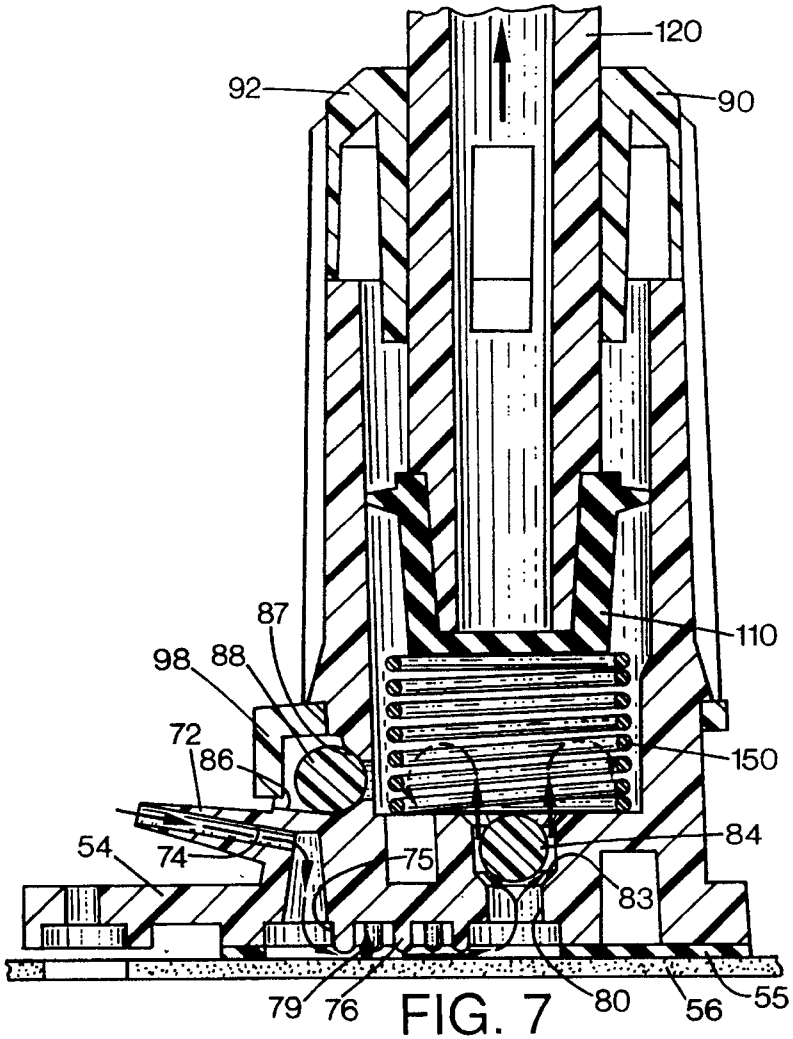
FIGS. 6 and 7 are enlarged elevational cross sectional views of a portion of the pump of FIG. 2, with FIG. 6 showing a compression portion of the priming cycle, and FIG. 7 showing an extraction portion of the priming cycle.

Referring now to FIG. 7, a beginning portion of the extraction stroke is shown, with the piston 120 continuing to rise as spring 150 expands until the piston returns to its relaxed position, as shown in FIG. 3. During this extraction phase, the outlet ball valve 88 seals the main chamber 82 at seat 87, and the inlet ball valve 84 is open. When valve 88 is open, ink is then drawn through the nozzles of pen 30 or 32, as selected by the position of valve 53, then through the conduit assembly 51, passageway 74, and into the ink entrapment chamber 75.

To entrap and separate the ink from the purged ink and air mixture, the downwardly extending baffle fingers 76 create turbulence in the flow of the purged mixture, with the fingers 76 blocking the passage of the ink into the intermediate passageway 80. Ink droplets 79 form as ink particles land on fingers 76. As the droplets 79 increase in size, they eventually flow under the force of gravity downwardly onto the diaper material 56. Through capillary action, the droplets 79 deposited on diaper 56 then flow from a central region of the diaper to the outer regions 57. During routine servicing of the printer 20, the diaper 56 may be easily replaced with a fresh diaper.

During this extraction step, the air or other gases continue flowing through the entrapment chamber 75, then through the intermediate passageway 80, past the open inlet ball valve 84, into the main pump chamber 82, and through the outlet ball valve 88 to vent to atmosphere. It is apparent that the compression and extraction strokes of FIGS. 6 and 7 may be repeated several times in succession to accomplish priming. Indeed, for a typical inkjet cartridge, such as a model HP 51626A print cartridge supplied by the Hewlett-Packard Company, Palo Alto, Calif., assignee of the patent fights in the claimed invention, priming is typically accomplished in three strokes. It is possible to have several more strokes be applied without causing any harm to such a cartridge. While the strokes could be continued for a complete purging of gases from the ink lines, such a repeated stroking is not particularly preferred to purge the tubing assembly 51, because the cartridges 30, 32 will normally be in the capping station during priming. The tubing size may be selected by those skilled in the art, so that, when combined with the pump's pressure profile (described below with respect to FIG. 8), any ink remaining in the tubing assembly 51 is advantageously broken into small droplets by the end of the pressure profile. For example, the illustrated embodiment of pump 20 has been tested as described and shown herein, and no clogging of ink has been encountered when the ink within the tubing assembly 51 dries. Thus, the pens 30, 32 are primed for printing, and the tubing assembly 51, as well as pump 20, remain free of clogs and ready for the next priming cycle.

Figure 8:
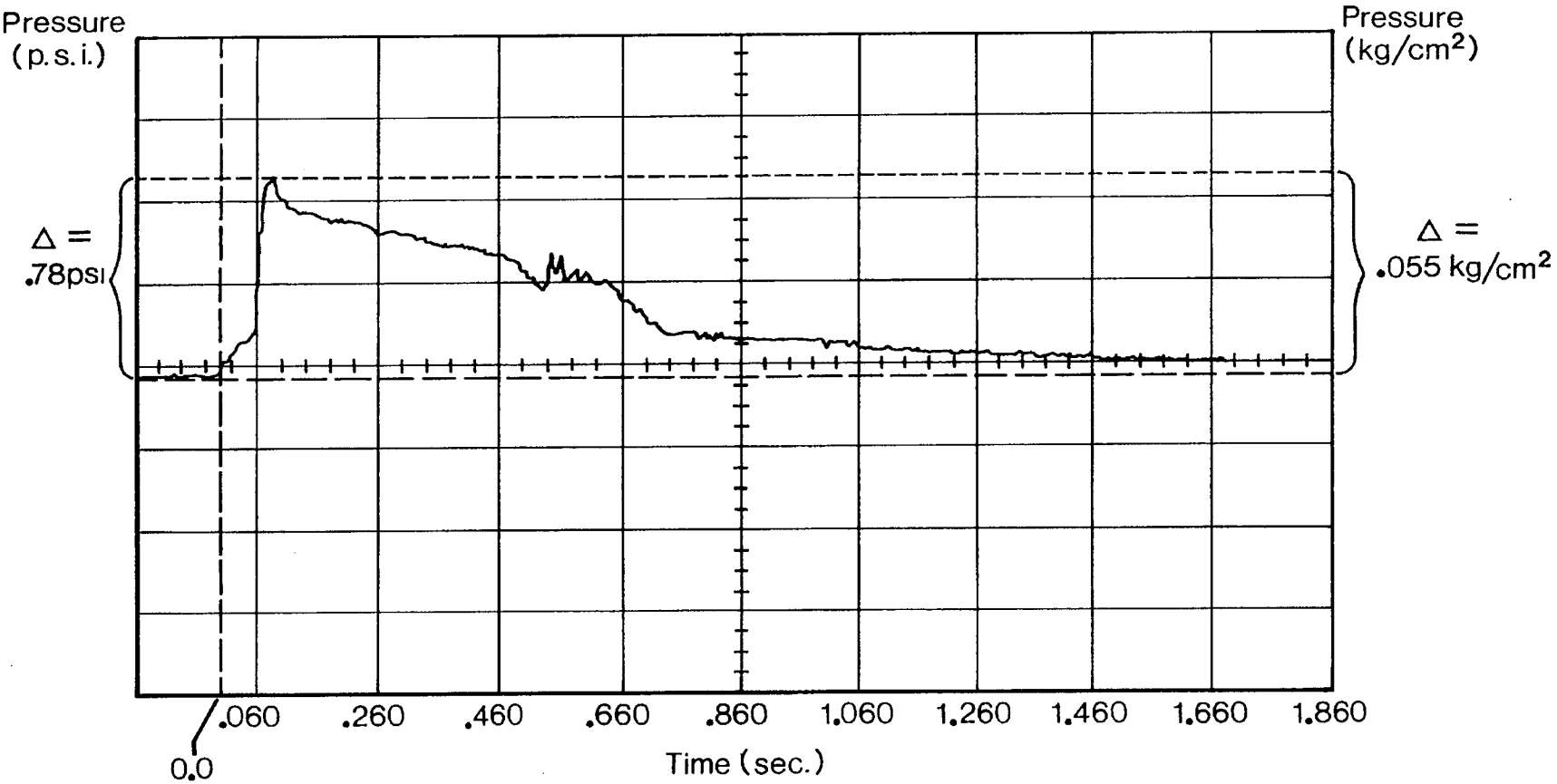
FIG. 8 is a graph of a pressure profile of the piston pump of FIG. 2.

Referring to FIG. 8, a graph is shown of the pressure profile created during the extraction phase (FIG. 7) of operating pump 50. Before time t=0, the pump 50 is fully compressed, and then at time t=0, the operator's finger 152 is removed from plunger 52. In a matter of slightly over sixty milliseconds, while valve 84 opens, the pressure provided by the pump 50 rises to its maximum value of 0.055 kg/cm$^2$ (0.78 psi). Over the next second, the pump pressure gradually declines returning to its steady state relaxed pressure (FIG. 3 ) by around two seconds after the initial release of plunger 52 by the operator. The area under the curve of FIG. 8 is directly proportional to the amount of ink withdrawn from the cartridge. The amount of ink withdrawn is a function of the back pressure in the cartridge, and is typically a fraction of a cubic centimeter (cc), on the order of 0.2 to 0.5 cc. Thus, within a matter of seconds, a series of several rapid strokes may be applied to plunger 52 to generate a vacuum to purge the nozzles and ink lines 51. Moreover, the rapid pressure build-up of pump 50 assists in dislodging any clogs which may have occurred within the nozzles or ink lines.

Figure 9:
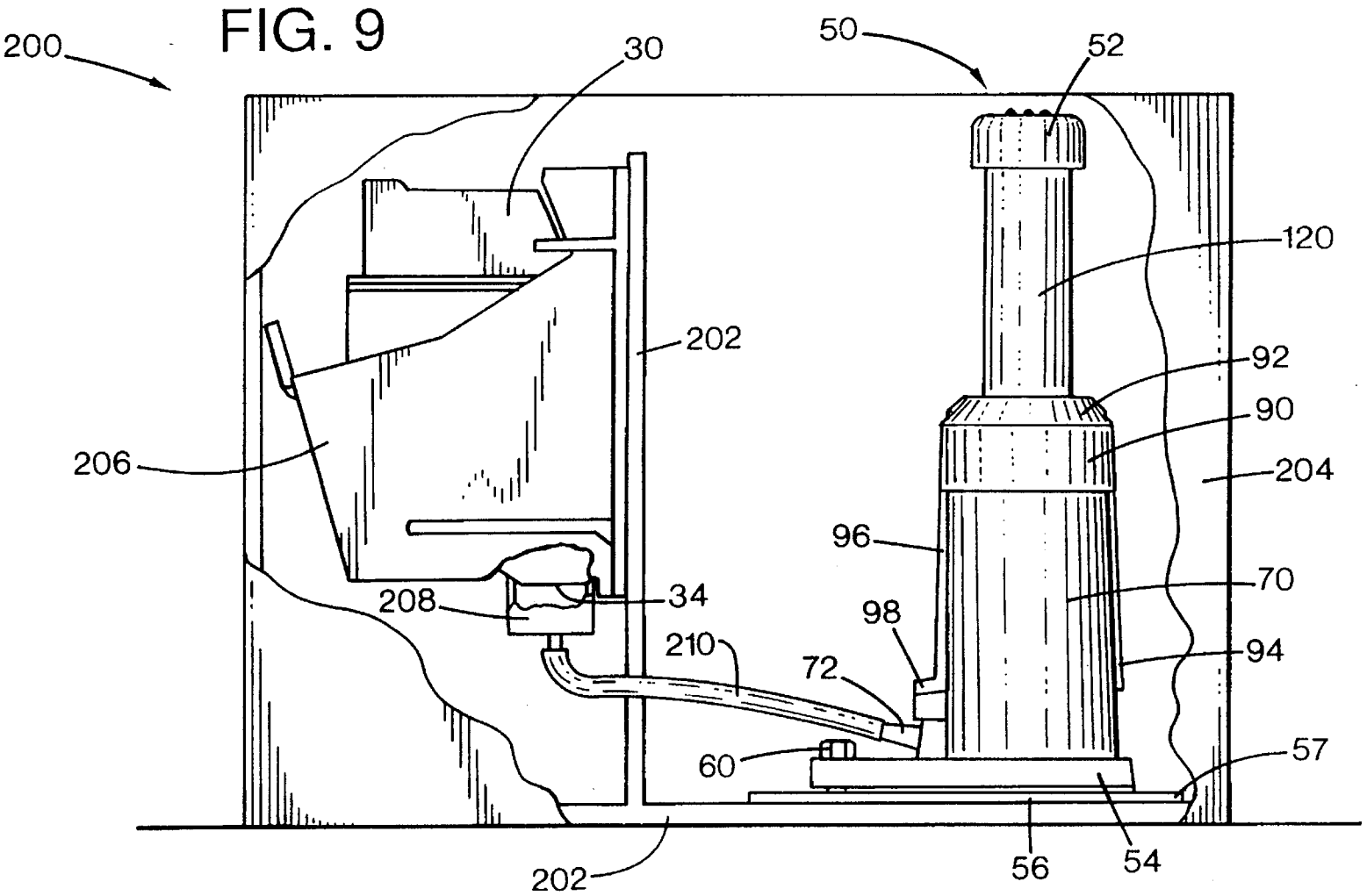
FIG. 9 is a perspective view of one form of an inkjet cartridge priming apparatus of the present invention including the pump of FIG. 2.

Referring to FIG. 9, a separate ink priming apparatus 200 is shown for priming a cartridge when not mounted in the printer carriage 35. The priming apparatus 200 may either be mounted to the printer chassis 22, for instance in the location shown in FIG. 1 but without the priming conduit assembly 51, or used separately therefrom, such as when resting on a work surface, as shown in FIG. 9. Preferably the apparatus 200 is portable, and has a frame 202 which may be enclosed or partially enclosed by an optional housing 204, leaving the plunger 52 accessible to an operator. The frame 202 supports an ink cartridge support mechanism 206, which supports at least one of the pen cartridges, such as cartridge 30. Here the support mechanism 206 is illustrated as having a construction similar to the cartridge-retaining portion of carriage 35 (FIG. 1), although it is apparent that other structures may be configured for supporting the pen cartridges. The printhead 34 of illustrated pen 30 is sealed, for instance by a cap member 208, which may be constructed of conventional elastomeric cap material. A length of tubing 210 joins the interior of cap 208 ant the printhead nozzles to the inlet portion 72 of pump 50. To prime the pen 30, the pump 50 may be operated as described above. After priming, the pen 30 or 32 is ready for removal from apparatus 200, and ready for return to the printer 20.

Thus, pump 50 provides a lightweight, simple and efficient purging mechanism, which is economical to manufacture in terms of both material and assembly costs. The pump 50 occupies a relatively small space within printer 20, as well as occupying a small space (i.e. a small work surface "footprint") when assembled as a stand-alone unit 200. Moreover, pump 50 provides an effective pressure profile (FIG, 8) to effectively and quickly prime ink from the pen cartridges 30, 32. The controlled pressure profile of pump 50 also provides a controlled flow rate for use in servicing the print cartridge 30 during, or prior to, printing. Additionally, pump 50 traps the extracted on the diaper material 56, which may be replaced as needed during periodic servicing or routine maintenance of printer 20. The body 70, cover 90, piston 120, and plunger 52 are preferably constructed from injection molded plastics, which provides parts that are compact, lightweight, and durable, as well as being easy to manufacture and assemble.

I claim:

1. A priming apparatus for priming an inkjet cartridge pen having a printhead, comprising:

a frame;

mounted to the frame, a pen support configured to support the pen;

a body defining a main chamber, the body supported by the frame to define an ink entrapment chamber therebetween, with the body also defining a series of baffles in the entrapment chamber;

an activation device slidably coupled to the body to draw a vacuum on the printhead when the priming apparatus is placed in fluid communication therewith to purge a mixture of ink and gaseous compounds accumulated in the printhead;

a first valve responsive to the activation device to selectively place the entrapment chamber in fluid communication with the main chamber; and wherein the body defines the entrapment chamber in a configuration to receive said accumulated mixture upon operation of the activation device, with the baffles arranged to impede the flow of ink through the entrapment chamber and to allow the gaseous compounds to vent to atmosphere through the main chamber, and with each baffle having a surface to collect the ink thereon to extract ink from the purged mixture.

2. A priming apparatus according to claim 1, wherein the body defines a ceiling surface of the entrapment chamber, and each of the baffles comprises an elongate member extending from the ceiling surface.

3. A priming apparatus according to claim 2 wherein:

the activation device includes a plunger which has a lower extremity extending into the main chamber;

the apparatus further includes a cup-shaped elastomeric washer member that receives the lower extremity of the plunger and provides a seal for an upper portion of the main chamber; and the apparatus further includes a spring member which biases the plunger in an upward direction for maximum main chamber volume.

4. A priming pump apparatus according to claim 3 wherein:

the body defines the main chamber as having inlet and outlet ports, the inlet port sealable by the first valve;

the apparatus also includes a second valve comprising a bail valve for selectively sealing the outlet port;

the apparatus further includes a cover member for slidably receiving the plunger, with the cover cooperating with the body to retain the second valve when the outlet port is open.

5. A priming pump apparatus according to claim 4 further including a layer of an absorbent material sandwiched between the frame and the entrapment chamber to absorb the extracted ink which rolls downwardly along the baffles under the force of gravity and then falls onto the absorbent material layer.

6. A priming pump apparatus for use in an inkjet printing mechanism having an inkjet printhead, comprising:

a body defining a main chamber having inlet and outlet ports, the body being mountable to a surface for defining an ink entrapment chamber between the body and said surface when mounted thereto;

an activation device operable to draw a vacuum on the printhead when the priming apparatus is placed in fluid communication therewith to purge a mixture of ink and gaseous compounds accumulated in the printhead; and an intermediate valve that selectively places the entrapment chamber in fluid communication with the main chamber;

wherein the body defines a ceiling surface of the entrapment chamber in a configuration to receive said accumulated mixture upon operation of the activation device, with the body also defining a series of baffles in the entrapment chamber to separate the ink from the gaseous compounds, with each of the baffles comprising an elongate member extending from the ceiling surface in an arrangement to impede the flow of ink through the entrapment chamber and to extract ink from the purged mixture by collecting the ink along the elongate members, and wherein the elongate members are also arranged to allow the gaseous compounds to flow through the entrapment chamber and then through the intermediate valve to vent to atmosphere through the main chamber outlet port.

7. A priming pump apparatus according to claim 6 further including a layer of an absorbent material sandwiched between said surface and the entrapment chamber to absorb the extracted ink which rolls downwardly along the elongate members under the force of gravity and then falls onto the absorbent material layer.

8. A priming pump apparatus according to claim 6 wherein:

the intermediate valve comprises an inlet ball valve for selectively sealing the inlet port of the main chamber; and the apparatus further includes an outlet ball valve for selectively sealing the outlet port of the main chamber.

9. A priming pump apparatus according to claim 8 wherein:

the activation device includes a plunger which is depressible to define a compression stroke portion of operation and releasable to define an extraction stroke portion of operation;

the body defines inlet and outlet valve seats adjacent the respective inlet and outlet ports of the main chamber; and the body and the inlet and outlet ball valves are configured such that during the compression stroke portion, the inlet ball valve seals the inlet port, and the outlet valve remains open to vent any gases within the main chamber to atmosphere, and during the extraction stroke portion, the outlet ball valve seals the outlet port, and the inlet valve remains open to draw a vacuum on the printhead and to allow separated gases to enter the main chamber.

10. A priming pump apparatus according to claim 8, further including a cover member surrounding a portion of the body, with the cover cooperating with the body to retain the outlet ball valve when the outlet port is open.

11. A priming pump apparatus according to claim 6, further including:

a cover member for slidably receiving the activation device, with the cover member cooperating with the activation device to prevent rotation of the activation device with respect to the body; and a retaining member configured to cooperate with the cover member to retain the activation device within the cover member.

12. A priming pump apparatus according to claim 6 wherein:

the body further defines the main chamber as having an upper portion;

the apparatus further includes a cover member for slidably receiving the activation device;

the activation device has a plunger with a lower extremity extending into the main chamber;

the apparatus also includes a cup-shaped elastomeric washer member that receives the lower extremity of the plunger and provides a seal for the upper portion of the main chamber; and the apparatus further includes a spring member which biases the activation device in an upward direction for maximum main chamber volume.

13. A priming pump apparatus according to claim 6 wherein:

the body defines inlet and outlet valve seats adjacent the respective inlet and outlet ports of the main chamber;

the activation device includes a plunger which is depressible during a compression stroke portion of operation and releasable during an extraction stroke portion of operation, with the plunger having a lower extremity extending into the main chamber;

the intermediate valve comprises an inlet ball valve for selectively sealing the inlet port of the main chamber;

the apparatus further includes:

a layer of an absorbent material sandwiched between said surface and the entrapment chamber to absorb the extracted ink;

an outlet ball valve for selectively sealing the outlet port of the main chamber;

a cover member for slidably receiving the plunger, with the cover cooperating with the body to retain the outlet ball valve when the outlet port is open;

a retaining member configured to cooperate with the cover member to retain the plunger within the cover member;

a cup-shaped elastomeric washer member that receives the lower extremity of the plunger and provides a seal for an upper portion of the main chamber; and a spring member which biases the plunger in an upward direction for maximum main chamber volume.

14. An ink jet printing mechanism, comprising:

a chassis;

a surface supported by the chassis;

a print medium handling system for supplying a print medium to a printing zone;

a printhead carriage system which propels an inkjet pen comprising an ink reservoir and a printhead across the printing zone to selectively deposit ink on the print medium; and a priming pump supported by the chassis to be selectively placed in fluid communication with the printhead, with the pump including:

a body mounted to said surface, with the body defining a main chamber having inlet and outlet ports, and with the body further defining an ink entrapment chamber between the body and said surface;

an activation device operable to draw a vacuum on the printhead when placed in fluid communication therewith to purge a mixture of ink and gaseous compounds accumulated in the printhead; and an intermediate valve that selectively places the entrapment chamber in fluid communication with the main chamber;

wherein the body defines a ceiling surface of the entrapment chamber in a configuration to receive said accumulated mixture upon operation of the activation device, with the body also defining a series of baffles in the entrapment chamber to separate the ink from the gaseous compounds, with each of the baffles comprising an elongate member extending from the ceiling surface in an arrangement to impede the flow of ink through the entrapment chamber and to extract ink from the purged mixture by collecting the ink along the elongate members, and wherein the elongate members are also arranged to allow the gaseous compounds to flow through the entrapment chamber and then through the intermediate valve to vent to atmosphere through the main chamber outlet port.

15. An ink jet printing mechanism according to claim 14 further including a service station supported by the chassis for servicing the pen, with a cap portion of the service station coupling the printhead to the priming pump.

16. An ink jet printing mechanism according to claim 15 wherein:

said cap portion of the service station comprises a first cap portion, and the service station further includes a second cap portion;

said pen comprises a first inkjet pen;

the mechanism further includes a second inkjet pen which has a printhead coupled by the second cap portion of the service station to the priming pump; and the mechanism also includes a valve for selectively coupling a selected one of the first and second pens to the pump.

17. An ink jet printing mechanism according to claim 16 includes a pen support for supporting the pen separate from the carriage system during purging.

18. A method of priming an inkjet cartridge pen used in an inkjet printing mechanism, comprising the steps of:

removing the pen from the inkjet printing mechanism;

providing a priming pump including a pen support for supporting the pen, an activation device operable to draw a vacuum on a printhead of the pen when placed in fluid communication therewith to purge a mixture of ink and gaseous compounds accumulated in the printhead, the pump having an outlet port which vents the gaseous compounds to atmosphere, with the pump also having an ink entrapment chamber with a baffled interior with plural members arranged in a maze-work and extending downwardly from a ceiling of the entrapment chamber;

placing the pen in the pen support of the priming pump;

stroking the activation device to purge the mixture of ink and gaseous compounds from the pen and to pull said mixture into the ink entrapment chamber; and separating any ink from the gaseous compounds in the entrapment chamber by (1) collecting ink along the plural members, and by (2) allowing the gaseous compounds to flow through the maze-work in the entrapment chamber to vent to atmosphere through the outlet port.

19. A method according to claim 18, wherein the stroking step comprises drawing a vacuum on the printhead comprising a pressure profile having a rapid rise on the order of milliseconds to a maximum pressure value, with a gradually declining return on the order of seconds to a steady state relaxed pressure.

* * * * *